United States Patent [19]

Lahaye

[11] Patent Number: 4,710,409

[45] Date of Patent: Dec. 1, 1987

[54] CONTROLLING AND REDUCING OPENING TORQUES OF CAPS AND LIDS

[75] Inventor: Marcel Lahaye, La Reid, Belgium

[73] Assignee: Spadel S.A., Brussels, Belgium

[21] Appl. No.: 850,243

[22] Filed: Apr. 10, 1986

[30] Foreign Application Priority Data

Apr. 16, 1985 [GB] United Kingdom ..... 8509745

[51] Int. Cl.[4] ..... B05D 1/02

[52] U.S. Cl. ..... 427/421; 215/295; 215/296; 215/DIG. 2

[58] Field of Search ..... 215/295, 296, DIG. 2; 427/421

[56] References Cited

U.S. PATENT DOCUMENTS 3,286,868 11/1966 Mumford ..... 215/295
4,324,601 4/1982 Dembicki et al. ..... 215/DIG. 2

FOREIGN PATENT DOCUMENTS 59-200649 11/1984 Japan ..... 215/DIG. 2

*Primary Examiner*—Shrive P. Beck
*Attorney, Agent, or Firm*—Woodcock Washburn Kurtz Mackiewicz & Norris

[57] ABSTRACT

An improved method for reducing opening torques of caps and lids on containers, in particular containers for food and beverages, which comprises covering the sliding surface of the said caps or lids and/or of the finish of the containers prior to closure with an appropriate lubricant. In a preferred embodiment the lubricant comprises a lubricating agent and an emulsifier.

11 Claims, No Drawings

CONTROLLING AND REDUCING OPENING TORQUES OF CAPS AND LIDS

This invention is concerned with a method of controlling and reducing opening torques of caps and lids used for the closure of containers. The invention is particularly concerned with caps and lids which, due to their nature, are intended for mere manual opening, such as, for example the many kinds of bottles, jars and pots used in the food and beverage industry. As examples of the various types of caps and lids to which the invention can be successfully applied, there can be mentioned screw caps, snap-on caps, twist crowns, twist-off lids and the like.

An especially indicated field of application of the present invention is concerned with screw caps and snap-on closures. Those are widely used in the food industry in general and specifically in the beverage industry. Screw caps and snap-on caps are actually used on bottles and other kinds of containers of various types, sizes and shapes, intended for the distribution and/or storage of the most divergent kinds of beverages, such as, for example, beer, wine, soft drinks, waters, milk, syrups, spirits, liquors, elixirs and other alcoholic and non-alcoholic beverages.

The containers used can be made of various materials, like, for example, siliceous materials, e.g. glass, ceramics, pottery, etc.; plastics, e.g. high or low density polyethylene, polypropylene, polyvinyl chloride, polystyrene, polyethylene terephtalate, co-polymers, composites etc.; metals, e.g. aluminum, tin, copper, steel, various alloys, etc.

The caps too can be made of various materials, including those mentioned above and, in particular, plastics and metal. In many cases, especially when large volumes are concerned, like with beer, milk, water or soft drinks, the containers are often returned to the filling station and re-used several times.

In general, the above-mentioned caps and lids provide adequate closure and, when appropriate torques are applied during the closing operation, or when the snap-on caps fit tightly enough on the finish of the container, the incidence of leakage can be kept minimal. However, in the present state of the relevant technique, it often happens that, under these premises, the caps or lids, when kept closed for some time, display an excessive resistance to manual opening. This tends to happen especially with bottles, which, due to the small diameter of the caps give little grip to the consumer's hand.

The problem is often aggravated by a number of external factors. Taking plastic screw caps on glass bottles as a typical example, opening torques increase e.g. with lower temperatures during storage and with decreasing air humidities. The influence of these factors can be explained by the following mechanisms, which are merely mentioned to depict the background of the problem, without any intention to be bound or limited thereby.

The humidity in the air tends to adsorb on surfaces exposed to it, forming a thin film of water molecules thereon. To a certain extent, this film acts as a lubricant and consequently reduces the surface's resistance to friction. With lower air humidities, the thickness of this film will decrease and a higher sliding resistance will ensue. Lower temperatures on the other hand act adversely by diminishing the elasticity of the materials and often also by a partially irreversible shrinking of the caps or lids.

The problem is also considerably greater with sugar-containing beverages. Indeed, traces of sugar and other ingredients like organic acids may crystallize or form a highly viscous syrup, acting as a glue.

At the first glance, a greater opening resistance of a cap or lid on a container seems to be a minor problem only: at the most a nuisance for the consumer. Looking at it more closely, however, one recognizes a serious problem and, for the concerned industries it is a major concern with many aspects and ramifications. In reality, its importance can be hardly overstated. Indeed, with the immense number of bottles annually used in the food industry, even small difficulties or unfortunate facts of low incidence have a more than significant impact.

In the first place, there is the nuisance to the consumer, who has to concentrate all his or her efforts to simply opening a bottle. He or she may even be compelled to use a tool, such as for example, a pair of tongs, which will not always be within reach. While a certain opening resistance of caps and lids will generally be accepted by the public, more extreme situations will be recognized as such. They may, for example, negatively influence the consumer's brand loyalty.

The consequences of a difficult to open cap may however be more serious than just a nuisance. For example, in an effort to overcome the resistance of the cap, the user may be inclined to hold the container in an inappropriate position, with the result that, once open, part of its content comes out and is spilled on clothings, carpets, etc. This happens especially often with carbonated beverages, which, due to the shaking, start fizzing violently.

Finally, and not in the least, it happens that glass bottles or other containers break, mostly due to excessive forcing or the use of inappropriate tools. In many such situations, personal injury is caused to the consumer. Questions arise as the manufacturer's liability. They form the subject of long lasting and embarassing lawsuits. In any case, the manufacturer's fame is at stake.

The problem is recognized for several years now and, despite many efforts to find a satisfactory solution, not one has been found thus far. The most obvious solution would of course be to use lower closing torques or less tight snap-on caps. Acceptable opening torques are in the order of about 6 to about 25 pounds×inch (7 to 29 kg×cm). Even when closing the containers with torques at the lower limit of this range—risking thereby an unacceptable incidence of leaking containers—the result is not always satisfactory.

As explained above, external circumstances may play an aggravating role. Indeed, cases have been studied where original opening torques of 7 or 8 pounds×inch (8 to 9 kg×cm) increased to over 30 pounds×inch (35 kg×cm) after storage.

A different solution has been launched at the level of the closing machinery, which has been equipped for this purpose with magnetic closing heads. Although these attempts have resulted in some improvement, the whole remains till now commercially unacceptable.

Still other solutions have been sought in the use of modified caps or lids, which have been proposed and actually tried in a dozen of versions. All of these approaches were eventually dropped as they impair some of the essential characteristics of the caps or lids, e.g. their tightness. Attempts have also been made to lubrify the caps by mixing a lubricant throughout the mass of the plastic material. For example, in French Patent Publication No. 2 442 777 there are described caps with an improved opening resistance which comprise a mixture of a crystalline polyolefin, a barely crystalline or amorphous co-polymer of ethylene with another olefin, a lubricant and a polymer which contains at least 10% by weight of a conjugated diene. The concerned caps have the disadvantage of being expensive while still showing a wide variability of opening torques and often unsatisfactory results. In general, it can be said that some improvement is achieved this way but, overall, the achievement is too small to adequately solve the problem or to justify the extra cost.

Similarly, in U.S. Pat. No. 3,920,143 there are described plastic caps which are made of two layers, the inside layer containing an additive which reduces the rubbing factor, while the outside layer may have different characteristics. The disadvantages of this system are similar to those mentioned above.

The use of externally applied lubricants to facilitate the introduction of corks in bottles or stoppers in beer vessels has been the subject of inventions (see German Offenlegungsschrift No. 30 35 646 Al, respectively French Patent Publication No. 2 385 642). It will be appreciated that the purpose of such treatment is totally different from that pursued by the present invention while the effect of it on the opening resistance of the said corks and stoppers has not been reported. In the particular circumstances, one would expect that tight closure of the thus stoppered bottles and vessels rather than a smaller opening resistance is of primordial importance.

Compared with the above, the solution provided by the present invention is yet simple, inexpensive and effective. In principle, it consists in coating the sliding surface of the caps or lids and/or the finish of the containers with a film of an appropriate lubricant. Theoretically, the lubricant can be applied by various means, e.g. by dipping, smearing, brushing, spraying etc., whereby the lubricant can be applied as such undiluted, or, preferably, in admixture with appropriate solvents or diluents. In a preferred method according to the invention, the lubricant is applied to the sliding surface of the caps or lids by spraying the latter with a lubricating formulation containing the lubricant in a suitable diluent, preferably water. Other diluents, in particular organic solvents, may be used as well.

Evidently, for use in connection with food containers or beverage bottles, any such diluents must be completely non-toxic and food-compatible, such as, for example, ethanol, glycerol etc.. For example, when using a volatile solvent like ethanol as a diluent, it will evaporate more quickly. In certain circumstances this may be an advantage. In general, however, the use of non-aqueous diluents will bring with it more disadvantages than benefits.

The lubricant chosen must be such as to fully comply with the particular requirements of the situation. In the case of beverage or food containers, the lubricant must, of course, be food-compatible, devoid of any undesirable taste and preferably tasteless, and inert with regard to the materials employed. It must combine excellent lubricating power with good spreading properties. It is further desirable to use a lubricant which allows heat sterilisation of the lubricating formulation without impairment of the chemical or physical stability thereof.

In particularly preferred embodiment according to the invention, the lubricant comprises a mixture of a lubricating agent and an emulsifier. Consequently, the lubricating formulation for application to the sliding surface will comprise a lubricating agent and an emulsifier in water.

Suitable lubricating agents are liquids with strong lubricating potential, such as, for example, mineral oils, e.g. soya oil, corn oil, peanut oil, sesame oil, and in particular castor oil or ricinus oil. Appropriate emulsifiers include non-toxic non-ionic surfactants which are virtually tasteless at the concentrations employed, or at least devoid of any unpleasant or undesired taste. As examples of such emulsifiers can be mentioned sorbitan polyoxyethylene fatty acid esters, in particular sorbitan polyethylene (20) mono-oleate (i.e. tween 80).

The ratio of the lubricating agent to the emulsifier and their concentration in the lubricating formulation may vary within wide limits, depending upon the circumstances. For example, the volume-to-volume ratio of the lubricating agent to the emulsifier may appropriately be chosen between 0.01 and 100; preferably between 0.1 and 10; and in particular between 0.5 and 2. In practical conditions a one-to-one ratio has been found especially useful. The total concentration of the lubricating agent and of the emulsifier (i.e. the lubricant) in the lubricating formulation will also depend on the circumstances and, in the first place, on the technique used to apply the lubricant. Hence, in extreme situations, the lubricant may be applied undiluted, e.g. by using a very low volume spray technique, for example with a so-called atomizer. In general, however, the use of a diluted lubricating formulation will be largely preferred. In such circumstances, the concentration of the lubricant in the formulation will typically be from about 0.001 to about 10% by volume and preferably from about 0.01 to 1%. Concentrations in the order of 0.1% have been found particularly useful. Apart from the lubricating agent, the emulsifier and the diluent, the lubricating fomulation may contain any other components which do not impair its essential characteristics.

In principle, the lubricant can be applied at any time before the closure of the containers. Practical considerations make it however preferable to apply the lubricant either immediately after the manufacture of the caps or lids—i.e. before they are packed—or, in the alternative, shortly before closing the containers. The second alternative has certain advantages compared to the first. Indeed, when the lubricant is applied immediately after the manufacture of the caps or lids, the latter tend to attract dust or may be the subject of microbial contamination. It is therefore preferred to apply the lubricant—and in particular to spray the sliding surfaces of caps or lids and/or of the finishes of the containers—in close connection with the closing operation. In a most preferred; embodiment, the spraying operation is connected on-line with the closing operation. In normal operating conditions this means that the caps or lids are sprayed underneath while they pass through the feeder of the closing machine.

The invention is further illustrated by the following examples which are intended to exemplify and not to limit the scope thereof.

EXAMPLE I

A. Preparation of the lubricating formulation 50 ml of sorbitan polyoxyethylene (20) mono-oleate (tween 80) are intimately mixed with 50 ml of castor oil. Then 100 l of warm water (60° C.) are added under stirring to obtain a homogeneous emulsion. The latter is sterilized by heat before use.

B. Evaluation of the lubricating formulation

The lubricating formulation prepared as described under A was tested under normal operating conditions, using plastic screw caps of the type AO Cap 333 on MCA2 finished 1 liter glass bottles.

The bottles were filled with orange soft drink (orangeade) and closed following the standard procedure. The lubricating formulation was applied by spraying the inner side of the caps till drip-off with the formulation. The caps were sprayed while passing the chute leading to the closing heads.

The effect of the lubrification on the opening torques was evaluated by measuring opening torques of each 12 untreated and 12 treated bottles respectively 24 hours, 8 days, 3 weeks and 5 weeks after closure.

The results of this experiment are summarized in the following Table I.

TABLE I

| | Mean opening torques (X); Standard deviation ($\sigma$) (in kg × cm) | | | |
|---|---|---|---|---|
| | Without lubrification | | With lubrification | |
| Storage time | X | $\sigma$ | X | $\sigma$ |
| 24 hours | 15.4 | 1.21 | 13.8 | 0.76 |
| 1 week | 21.5 | 5.03 | 17.0 | 1.70 |
| 3 weeks | 26.0 | 5.63 | 16.0 | 3.06 |
| 5 weeks | 25.7 | 5.85 | 15.7 | 2.66 |

These results clearly indicate that opening torques with lubrification according to the invention are significantly lower and much more uniform than without lubrification.

EXAMPLE II

Following the procedure described in Example I, the effect of lubrification with the composition of Example I-A was evaluated with respect to opening torques of plastic screw caps on 1.5 l polyethylene terephtalate (PET) bottles, filled with orange soft drink (orangeade). The results of this experiment are summarized in Table II.

TABLE II

| | Mean opening torques (X); Standard deviation ($\sigma$) (in kg × cm) | | | |
|---|---|---|---|---|
| | Without lubrification | | With lubrification | |
| Storage time | X | $\sigma$ | X | $\sigma$ |
| 24 hours | 11.0 | 2.68 | 8.6 | 2.60 |
| 1 week | 10.8 | 2.22 | 9.2 | 2.60 |
| 3 weeks | 11.1 | 3.56 | 10.3 | 2.00 |
| 4 weeks | 12.9 | 2.52 | 10.1 | 1.83 |

EXAMPLE III

The effect of lubrification with the composition of Example I-A was tested with respect to the opening resistance of plastic snap-on caps on 1.5 l polyvinyl chloride (PVC) bottles filled with mineral water.

Two lots of PVC bottles, filled with mineral water, were closed with plastic snap-on caps (non-lubrified plastic mass-type Monalca) respectively without and with external lubrification (by spraying). Heavy and light bottles were equally distributed over both lots. Opening resistance was evaluated manually at various time intervals and rated in accordance with the following score system.

| Score | Qualification |
|---|---|
| 1 | very easy |
| 2 | easy |
| 3 | acceptable |
| 4 | difficult |
| 5 | very difficult |
| 6 | impossible |

Based on this criterium, the results listed in Table III were obtained.

TABLE III

| Opening resistance of snap-on caps expressed as % of number tested yielding indicated score. | | | | | | |
|---|---|---|---|---|---|---|
| | % with indicated score | | | | | |
| Storage time | 1 | 2 | 3 | 4 | 5 | 6 |
| A: Without external lubrification | | | | | | |
| 0 | 0 | 0 | 0 | 8 | 17 | 75 |
| 24 hours | 0 | 0 | 8 | 8 | 9 | 75 |
| 48 hours | 0 | 0 | 25 | 33 | 0 | 42 |
| 1 week | 0 | 8 | 50 | 17 | 17 | 8 |
| 2 weeks | 0 | 8 | 9 | 33 | 8 | 42 |
| B: With external lubrification | | | | | | |
| 0 | 41 | 17 | 42 | 0 | 0 | 0 |
| 24 hours | 25 | 33 | 34 | 8 | 0 | 0 |
| 48 hours | 33 | 42 | 25 | 0 | 0 | 0 |
| 1 week | 42 | 41 | 17 | 0 | 0 | 0 |
| 2 weeks | 17 | 42 | 41 | 0 | 0 | 0 |

The positive effect of external lubrification on the opening resistance of snap-on caps in accordance with the invention is clearly demonstrated by the shift to lower resistance scores.

I claim:

1. A method of reducing opening torques of caps and lids on containers comprising covering the sliding surface of said caps or lids and/or of the finish of the containers prior to closure with an appropriate lubricant applied by contacting the sliding surface of the caps or lids and/or of the finish of the containers prior to closure with a lubricating formulation containing from 0.001 to 10% by volume of the lubricant in the appropriate diluent.

2. A method according to claim 1 wherein the said lubricant comprises a lubricating agent and an emulsifier.

3. A method according to claim 2 wherein the said lubricating agent is a mineral or vegetable oil and the said emulsifier in a sorbitan polyoxyethylene fatty acid ester.

4. A method according to claim 3 wherein the said lubricating agent is castor oil, the said emulsifier is sorbitan polyoxyethylene (20) mono-oleate and the said diluent is water.

5. A method of reducing opening torques of caps and lids on containers for food and beverage products which comprises spraying the sliding surface of the said caps and lids prior to closure with a lubricating formulation containing a lubricating agent and an emulsifer in an appropriate diluent.

6. A method according to claim 5 wherein the said caps and lids are screw caps, snap-on caps, twist crowns or twist-off lids and the said containers are bottles, jars or pots.

7. A method according to claim 6 wherein the said containers are containers for the distribution and/or storage of food and beverage products selected from the group consisting of drinking water, milk, fruit juice, soft drink, beer, wine, liquor, elixir, spirit and syrup.

8. A method of reducing opening torques of caps on bottles for beverages which comprises spraying the sliding surface of the said caps prior to closure with a lubricating formulation containing a lubricating agent and an emulsifier in an appropriate diluent.

9. A method according to claim 8 wherein the said caps are screw caps or snap-on caps and the said caps and bottles are independently of each other made of a material selected from the group consisting of siliceous materials, plastics and metals.

10. A method according to claim 9 wherein the said lubricating agent is castor oil, the said emulsifier is sorbitan polyoxyethylene (20) mono-oleate and the said diluent is water.

11. A method according to claim 10 wherein the said caps are made of plastic and the said bottles are made of glass or plastic.

* * * * *